US012516407B2

(12) United States Patent
Bisol

(10) Patent No.: US 12,516,407 B2
(45) Date of Patent: Jan. 6, 2026

(54) SINGLE-DOSE CAPSULE FOR GALVANIZING BATHS

(71) Applicant: SOPRIN S.R.L., Maserada sul Piave (IT)

(72) Inventor: Marco Bisol, Maserda sul Piave (IT)

(73) Assignee: SOPRIN S.R.L., Maserada sul Piave (IT)

( * ) Notice: Subject to any disclaimer, the term of this patent is extended or adjusted under 35 U.S.C. 154(b) by 407 days.

(21) Appl. No.: 17/766,801

(22) PCT Filed: Oct. 15, 2020

(86) PCT No.: PCT/IB2020/059705

§ 371 (c)(1),
(2) Date: Apr. 6, 2022

(87) PCT Pub. No.: WO2021/074844

PCT Pub. Date: Apr. 22, 2021

(65) Prior Publication Data

US 2023/0175110 A1 Jun. 8, 2023

(30) Foreign Application Priority Data

Oct. 15, 2019 (IT) ..... 102019000018917

(51) Int. Cl.
*C23C 2/06* (2006.01)

(52) U.S. Cl.
CPC ..... *C23C 2/06* (2013.01)

(58) Field of Classification Search
CPC ..... C23C 2/06; C23C 2/30
See application file for complete search history.

(56) References Cited

U.S. PATENT DOCUMENTS

| | | | | | |
|---|---|---|---|---|---|
| 2,635,996 | A * | 4/1953 | Rohrback | C09K 8/54 | 507/275 |
| 3,512,959 | A * | 5/1970 | Wallace | C23C 2/30 | 75/655 |
| 5,284,680 | A * | 2/1994 | Bilimoria | C23C 2/40 | 427/398.1 |
| 2022/0290305 | A1 * | 9/2022 | Sonk | C23C 24/087 | |

FOREIGN PATENT DOCUMENTS

| | | | |
|---|---|---|---|
| CN | 101016609 | A * | 8/2007 |
| EP | 2725114 | A1 | 4/2014 |
| JP | 2503967 | Y2 * | 7/1996 |
| JP | 2749694 | B2 * | 5/1998 |
| RU | 2704148 | C1 | 10/2019 |

(Continued)

OTHER PUBLICATIONS

CN-101016609-A English translation. (Year: 2007).*

(Continued)

*Primary Examiner* — Hai Y Zhang
(74) *Attorney, Agent, or Firm* — Ballard Spahr LLP

(57) ABSTRACT

A single-dose capsule for galvanizing baths characterized in that it comprises: a closed container which is made of zinc or zinc alloy and has an overall volume of less than 2.5 $dm^3$; and a pre-set quantity of galvanizing bath additive, which comprises nickel powder and is entirely contained within said closed container.

16 Claims, 1 Drawing Sheet

(56) References Cited

FOREIGN PATENT DOCUMENTS

WO 2006123945 A1 11/2006

OTHER PUBLICATIONS

JP-2749694-B2 English translation. (Year: 1998).*
JP-2503967-Y2 English translation. (Year: 1996).*
American elements, Melting point reference sheet, the materials science manufacturer. (Year: 2010).*
International Search Report and Written Opinion from International Application No. PCT/IB2020/059705 mailed Jan. 25, 2021.

* cited by examiner

SINGLE-DOSE CAPSULE FOR GALVANIZING BATHS

CROSS-REFERENCE TO RELATED APPLICATIONS

This patent application is a U.S. Nationalization of International Application No. PCT/IB2020/059705 filed on Oct. 15, 2020, which claims priority from Italian application no. 102019000018917 filed on Oct. 15, 2019, the entire disclosure of which is incorporated herein by reference.

TECHNICAL FIELD

The present invention relates to a single-dose capsule for galvanizing baths.

In more detail, the present invention relates a single-dose capsule for baths of molten zinc to be used for hot galvanizing of metal objects, use to which the following disclosure will refer explicitly without however loss of generality.

BACKGROUND ART

As is known, galvanizing is an industrial process in which a metal object is covered with a fine layer of zinc to protect it from galvanic corrosion.

Hot galvanizing entails immersing the metal object for a predetermined time in a bath of molten zinc which is at a temperature of approximately 450° C., so that the liquid zinc metallurgically reacts with the surface of the object to be covered and can form, once solidified, a protective layer of appropriate thickness.

The different types of steel on the market have a different reactivity to the molten zinc, and this results in a different growth of the thickness of zinc on the surface of the article. Highly reactive steels, such as those with a high silicon and phosphorous content, have a zinc coating characterised by fragile and non-uniform additional thicknesses.

The main consequence of this fact is that the zinc coating, since it is very fragile, tends to crack easily thus reducing the corrosion protection of the article.

In addition, the high reactivity of the steel leads to an excessive consumption of zinc during the galvanizing process.

To counter these drawbacks, it is common practice to add even a small quantity of nickel to the zinc bath.

Unfortunately, to obtain the desired effects, the percentage of nickel in the molten zinc bath must remain stably within a very small predetermined range, therefore periodically an appropriate quantity of nickel must always be added according to the number of tons of galvanized material.

In the past, and still today in some countries in the world, the correct percentage of nickel in the molten zinc bath was restored manually by an operator, who metered and then poured the right quantity of nickel powder directly into the galvanizing tank.

Unfortunately, since nickel powder has been classified as a health hazard (EC Reg. 1272/2008: H351), metering and pouring of the nickel powder into the molten zinc bath obliges the operator to adopt a series of precautions/measures, which make this process relatively long and laborious.

To remedy these drawbacks, in recent years there have been marketed paraffin blocks that incorporate a given quantity of nickel powder and other additives.

Unfortunately, while making it safer to restore the correct percentage of nickel in the molten zinc bath (the paraffin blocks in fact can be handled by the operator without any particular precautions), the use of the paraffin blocks has led to an increase in production costs.

The contact of paraffin blocks with the molten zinc bath, in fact, causes the momentary production of dense oily hydrocarbon-based fumes that rapidly accumulate in the filters of the air filtering system of the galvanizing line prematurely compro-mising their correct operation, with the increased maintenance costs that this entails.

In addition, the use of paraffin blocks is less efficient than nickel powder. Experimental tests, in fact, have shown that almost 50% of the nickel contained in the paraffin blocks settles on the bottom of the galvanizing tank, and is incorporated in the solid mass that forms/deposits/settles on the bottom of the tank, traditionally called mattes.

Unfortunately the nickel that accumulates in the mattes does not contribute to raising the percentage of nickel actually dissolved in the molten zinc bath.

In proportion, therefore, the control of nickel percentage in the molten zinc bath with the aid of the paraffin blocks requires a higher quantity of nickel, resulting in increased production costs.

Another way of adding nickel to the molten zinc bath is to use zinc-nickel alloy ingots, with a nickel concentration of around 2%.

The use of zinc-nickel alloy ingots is safe for human health and does not entail additional costs for maintenance of the galvanization plant.

Unfortunately, despite these advantages, the zinc-nickel alloy ingots are the least efficient and most expensive way of adding nickel to the molten zinc bath, because they tend to immediately sink in the molten zinc bath, with all problems that this entails.

In fact, experimental tests have shown that the zinc-nickel alloy ingots have an efficiency of 30-40%. In other words, for every 1 kg of nickel introduced into the galvanization tank, 600-700 grams of nickel settle on the bottom of the galvanization tank and are incorporated in the mattes.

DISCLOSURE OF INVENTION

Aim of the present invention is to remedy, at limited cost, the drawbacks associated with the use of the paraffin blocks and zinc-nickel alloy ingots.

In accordance with these aims, according to the present invention there is provided a single-dose capsule for galvanizing baths is provided as defined in claim 1 and preferably, though not necessarily, in any one of the claims depending on it.

According to the present invention, it is also proposed a method for controlling the percentage of additive in a molten zinc bath.

BRIEF DESCRIPTION OF THE DRAWINGS

The present invention will now be described with reference to the attached drawings, which illustrate a non-limiting embodiment example thereof, in which:

FIG. 1 is an exploded perspective view of a single-dose capsule for galvanizing baths realized according to the teachings of the present invention; whereas

BEST MODE FOR CARRYING OUT THE INVENTION

Figure 1:
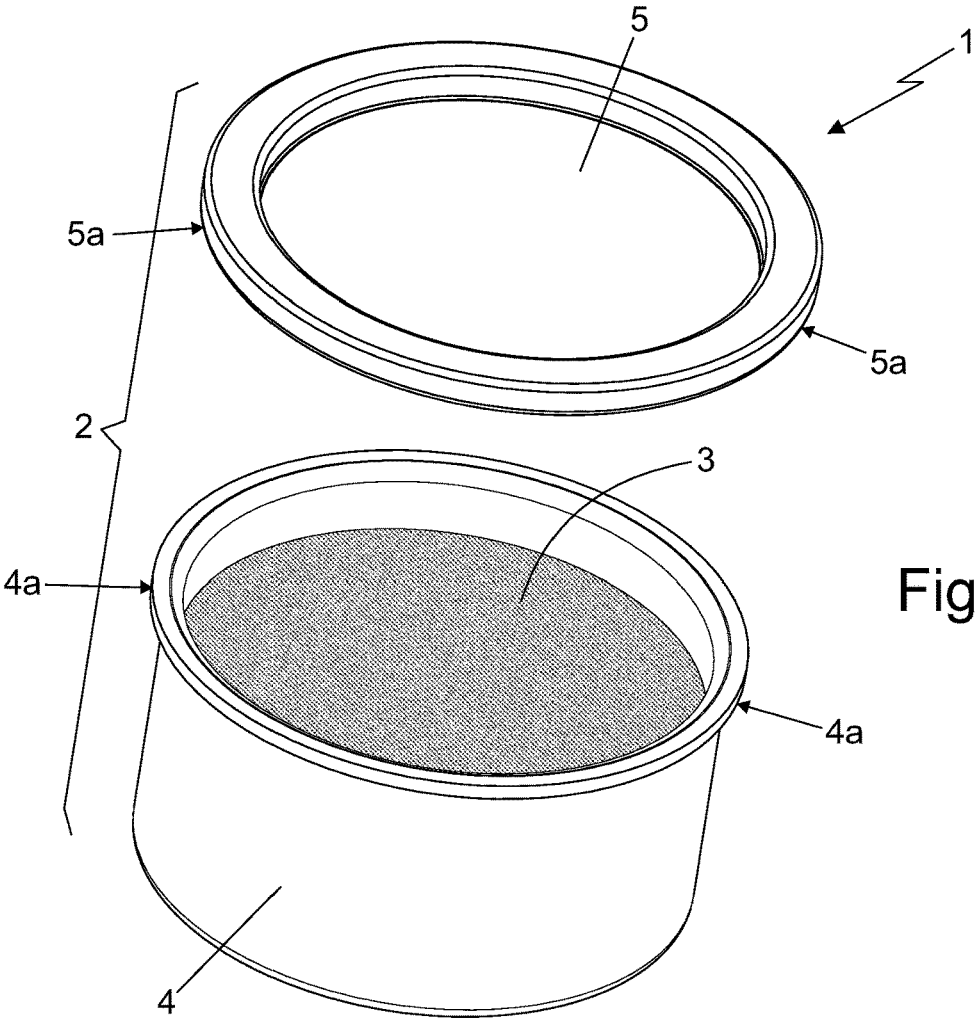
Figure 2:
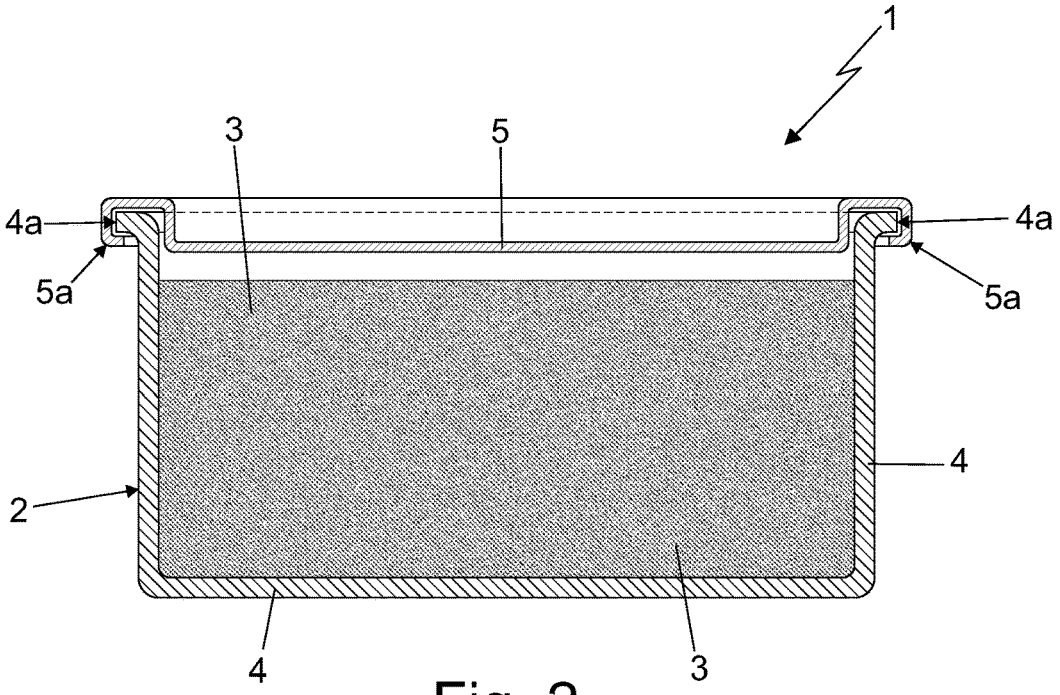
FIG. 2 is a lateral view of the single-dose capsule illustrated in FIG. 1, sectioned along the midplane.

With reference to FIGS. 1 and 2, number 1 denotes as a whole a single-dose capsule for galvanizing baths, which is specifically structured to be thrown/introduced by a person into the galvanizing tank containing the molten zinc bath, in such a way as to add a predetermined quantity of additive to said molten zinc bath.

The single-dose capsule 1 comprises: a substantially hermetically closed container 2 which has an overall volume of less than 2.5 $dm^3$ (cubic decimetres) and is made of a low-melting metal material, i.e. a metal material with melting temperature lower than 700° C. and, more conveniently, with a melting temperature lower than or equal to 500° C.; and a given quantity of galvanizing-bath additive 3, which is entirely contained within the closed container 2.

In more detail, the closed container 2 is preferably made of a metal material with melting temperature substantially equal to or lower than the melting temperature of the zinc.

The closed container 2, in addition, has an overall volume preferably ranging between 50 $cm^3$ (cubic centimetres), i.e. 0.05 $dm^3$ (cubic decimetres), and 2 $dm^3$ (cubic decimetres), and is preferably made of zinc or zinc alloy.

Preferably the single-dose capsule 1 has a specific weight lower than the nominal density of the molten zinc bath, so that it can temporarily float on the surface of the molten zinc bath.

In addition, the single-dose capsule 1 preferably has an overall weight of less than 5 kg and, more conveniently, ranging between 0.25 and 1.5 kg (kilograms). The galvanizing-bath additive 3, on the other hand, is preferably a powder material and is preferably composed mainly of nickel.

In more detail, the galvanizing-bath additive 3 is preferably composed mainly of metallic nickel and/or nickel salts (for example nickel chloride).

In addition, the galvanizing-bath additive 3 preferably has a particle size smaller than or equal to 3 mm, and preferably comprises nickel in a percentage greater than 50% and, more conveniently, also greater than 60%.

Preferably the galvanizing-bath additive 3 moreover comprises also zinc chloride, and more conveniently anhydrous zinc chloride, in a percentage lower than the nickel.

In more detail, the galvanizing-bath additive 3 preferably comprises zinc chloride in a percentage greater than 15% and, more conveniently, also greater than 20%.

In greater detail, the quantity of nickel is preferably substantially equal to 3,3 times the quantity of zinc chloride.

Optionally the galvanizing-bath additive 3 preferably also comprises aluminium and/or bismuth and/or copper and/or lead and/or tin and/or salts thereof, preferably in a percentage lower than the zinc chloride.

Preferably, though not necessarily, moreover the galvanizing-bath additive 3 can also comprise ammonium chloride and/or metal chlorides (for example bismuth chloride, tin chloride or strontium chloride) and/or borates (for example sodium borate), preferably in a percentage lower than the zinc chloride.

Furthermore, the nickel container in the galvanizing-bath additive 3 preferably has an average particle size smaller than 500 μm (micron) and, more conveniently, a particle size ranging between 45 and 250 μm (micron).

With reference to FIGS. 1 and 2, in addition, the closed container 2 preferably has a rigid structure and is optionally also substantially cylindrical in shape.

Preferably, the closed container 2 moreover has a capacity lower than or equal to 1 $dm^3$ (cubic decimetre) and, more conveniently, lower than or equal to 0,5 $dm^3$ (cubic decimetres).

In more detail, the closed container 2 preferably comprises: a cup-shaped body 4 preferably having a substantially cylindrical shape, which is made of said low-melting metal material, or rather of zinc; and a lid 5 preferably having a substantially discoidal shape, which closes substantially hermetically the cup-shaped body 4 and is similarly made of said low-melting metal material, or rather of zinc.

Preferably the lid 5 is furthermore securely fixed to the cup-shaped body 4 in a substantially unremovable manner.

In more detail, the lid 5 is preferably fixed on the cup-shaped body 4, or rather on the upper perimeter edge **4*a* of the cup-shaped body 4**, by means of seaming.

In other words, the lid 5 preferably consists of a metal plate preferably circular in shape, which has the perimeter edge **5*a* bent and deformed by force against the perimeter edge 4*a* of the cup-shaped body 4, in such a way as to cover and firmly grip the perimeter edge 4*a*** throughout its length.

The cup-shaped body 4, on the other hand, is preferably made by means of deep drawing.

With particular reference to FIGS. 1 and 2, in the example shown, in particular, the single-dose capsule 1 preferably has an overall weight less than or equal to 0.5 kg (kilograms).

In addition, the closed container 2 is preferably substantially cylindrical in shape, with external diameter ranging between 6 and 10 cm (centimetres) and height ranging between 2 and 3 cm (centimetres). Preferably the closed container 2 furthermore has a capacity of less than 300 $cm^3$ (cubic centimetres) and, more conveniently, between 50 and 200 $cm^3$ (cubic ranging centimetres).

In other words the closed container 2 preferably has a capacity of less than 0,3 $dm^3$ (cubic decimetres) and, more conveniently, ranging between 0,05 and 0,2 $dm^3$ (cubic decimetres).

In more detail, the closed container 2 preferably has an external diameter of approximately 8 cm (centimetres), a height of approximately 2.5 cm (centimetres), and a capacity of approximately 100-120 $cm^3$ (cubic centimetres), i.e. approximately 0,1-0,12 $dm^3$ (cubic decimetres).

The galvanizing-bath additive 3, on the other hand, is preferably composed mainly of metallic nickel powder.

In more detail, the galvanizing-bath additive 3 preferably has a percentage of nickel powder equal to approximately 76%, and a percentage of zinc chloride powder equal to approximately 23%.

Operation of the single-dose capsule 1 is easily inferable from the above description.

To control the percentage of additive present in the molten zinc bath, the operator must throw/pour/introduce one or more single-dose capsules 1 into the galvanizing tank containing the molten zinc bath. Clearly the number of single-dose capsules 1 depends on the quantity of molten zinc present in the galvanizing tank and/or on the quantity of molten zinc that is immersed in the tank in case of topping up and/or on the nickel consumption in case of topping up.

The advantages connected to the use of the single-dose capsule 1 are numerous.

Firstly, since container 2 is hermetically closed, the risks of the nickel powder being dispersed in the environment are practically nil.

In addition, production of the closed container 2 in zinc or other low-melting metal material compatible with the hot galvanizing process enormously simplifies management of the molten zinc bath.

The single-dose capsules 1, in fact, are much easier to handle than the paraffin blocks. Even transport and storage of the single-dose capsules 1 is much simpler and cheaper than that of paraffin blocks.

Furthermore the production of the closed container 2 in zinc or other low-melting metal materials avoids the production of fumes and oily vapours which rapidly compromise correct operation of the air filtering system.

In addition, experimental tests have shown that the single-dose capsules 1 significantly reduce the quantity of nickel that settles on the bottom of the galvanizing tank, and therefore raise the percentage of nickel actually dissolved in the molten zinc bath.

The efficiency of the single-dose capsules 1, in fact, is equal to 70-80%. Therefore for every 1 kg of nickel introduced into the galvanizing tank, only 200-300 grams of nickel settles on the bottom of the galvanizing tank and are incorporated into the solid mass that forms/deposits/settles on the bottom of the tank, traditionally called mattes.

In parallel, the same experimental tests have also shown that the use of the single-dose capsules 1 additionally reduces the dispersion times of the additive in the molten zinc bath.

It is finally clear that modifications and variations can be made to the single-dose capsule 1 described above without however departing from the scope of the present invention.

For example, instead of being fixed in a unremovable manner on the cup-shaped body 4 by means of seaming, the lid 5 could be screwed on the cup-shaped body 4, or could have the structure of a crown cap.

Lastly, in a less sophisticated embodiment, the closed container 2 could be made of aluminium, lead, tin, bismuth, copper or an alloy thereof.

The invention claimed is:

1. A single-dose capsule for galvanizing baths, the single-dose capsule comprising: a closed container that is made of low-melting metal material and has an overall volume of less than 2.5 $dm^3$, wherein the low-melting metal material has a melting temperature lower than or equal to 500° C.; and a given quantity of galvanizing-bath additive contained within said closed container, wherein the galvanizing-bath additive comprises nickel.

2. The single-dose capsule according to claim 1, wherein the galvanizing-bath additive comprises a powder material.

3. The single-dose capsule according to claim 2, wherein the galvanizing-bath additive has a particle size smaller than or equal to 3 mm.

4. The single-dose capsule according to claim 1, wherein a percentage of nickel in said galvanizing-bath additive is higher than 50%.

5. The single-dose capsule according to claim 1, wherein the nickel contained in said galvanizing-bath additive has an average particle size smaller than 500 μm.

6. The single-dose capsule according to claim 1, wherein the galvanizing-bath additive additionally contains zinc chloride.

7. The single-dose capsule according to claim 6, wherein the galvanizing-bath additive additionally comprises at least one of aluminium, bismuth, copper, lead, tin, or salts thereof.

8. The single-dose capsule according to claim 6, wherein the galvanizing-bath additive additionally comprises at least one of ammonium chloride, metal chlorides, or borates.

9. The single-dose capsule according to claim 1, wherein the closed container has a rigid structure.

10. The single-dose capsule according to claim 9, wherein the closed container comprises: a cup-shaped body made of low-melting metal material; and a lid made of low-melting metal material and which substantially hermetically closes said cup-shaped body.

11. The single-dose capsule according to claim 10, wherein the lid is fixed to the cup-shaped body in a substantially unremovable manner.

12. The single-dose capsule according to claim 11, wherein the lid is fixed on the cup-shaped body by seaming.

13. The single-dose capsule according to claim 1, wherein said closed container is made of zinc or zinc alloy.

14. The single-dose capsule according to claim 1, wherein said closed container has a capacity of less than 300 $cm^3$.

15. The single-dose capsule according to claim 1, wherein the average density of said single-dose capsule is less than the density of the bath of melted zinc and/or the overall weight of the single-dose capsule is less than 1.5 kg.

16. A method for controlling a percentage of additive in a bath of melted zinc, the method comprising:

at least one of throwing, pouring, or introducing into the galvanizing tank containing said bath of melted zinc at least one single-dose capsule as defined in claim 1.

* * * * *